US008857307B2

(12) United States Patent
Tresserras Torre et al.

(10) Patent No.: US 8,857,307 B2
(45) Date of Patent: Oct. 14, 2014

(54) METHOD FOR MANUFACTURING A BULL BARREL EQUIPPED WITH A SILENCER AND SILENCER-EQUIPPED BULL BARREL THUS OBTAINED

(75) Inventors: Victor Tresserras Torre, Barcelona (ES); Julian Arnedo Vera, Barcelona (ES)

(73) Assignee: Gamo Outdoor, S.L., Barcelona (ES)

( * ) Notice: Subject to any disclaimer, the term of this patent is extended or adjusted under 35 U.S.C. 154(b) by 0 days.

(21) Appl. No.: 13/979,465

(22) PCT Filed: Jan. 17, 2011

(86) PCT No.: PCT/ES2011/070024

§ 371 (c)(1),
(2), (4) Date: Sep. 20, 2013

(87) PCT Pub. No.: WO2012/098270

PCT Pub. Date: Jul. 26, 2012

(65) Prior Publication Data

US 2014/0007481 A1 Jan. 9, 2014

(51) Int. Cl.

| | |
|---|---|
| ***F41A 21/00*** | (2006.01) |
| ***F41A 21/30*** | (2006.01) |
| ***F41A 21/32*** | (2006.01) |
| ***F41A 21/02*** | (2006.01) |

(52) U.S. Cl.

CPC ..... *F41A 21/30* (2013.01); *F41A 21/325* (2013.01); *F41A 21/02* (2013.01)

USPC ..... 89/14.4; 89/14.05

(58) Field of Classification Search

CPC ..... F41A 21/30; F41A 21/34; F41A 21/44; F41A 21/02; F41A 21/325

USPC ..... 89/14.4, 14.05–14.3; 42/76.01

See application file for complete search history.

(56) References Cited

U.S. PATENT DOCUMENTS

| | | | | |
|---|---|---|---|---|
| 1,111,202 | A * | 9/1914 | Westfall | 89/14.4 |
| 1,296,193 | A * | 3/1919 | Johnston | 89/14.1 |

(Continued)

FOREIGN PATENT DOCUMENTS

| | | |
|---|---|---|
| WO | 9603612 | 2/1996 |

*Primary Examiner* — Michelle R Clement
(74) *Attorney, Agent, or Firm* — RatnerPrestia

(57) ABSTRACT

A manufacturing procedure for a "bull barrel" model with silencer and "model bull barrel" with obtained silencer.
It comprises the following stages: a first stage in which a tube (2), which defines two ends, a first (21) and a second (22), with an interior diameter that exceeds the outer diameter of the barrel (1), fixed to a wedge (19) by its first end (21), a second stage in which a muzzle (5) that ends in a hood (10) is fixed to the second end (22) of tube (2), with said muzzle (5) comprising at least one lateral aperture (6) and at least one first hoop (8) that fits inside the tube (2) sealing the second end (22), similarly with stops (7) that define channels (11) in the hood (10) that connect the exterior with the inside of the muzzle (5), with the mentioned stops (7) forming the end of travel for the referred tube (2), a third stage in which the barrel (1) is fixed to the muzzle (5) and to the wedge (19), thus defining a space or cavity (3) between the tube (2) and barrel (1) and a fourth stage in which the third stage configuration is inserted into a molding machine for over-molding, except for the barrel entrance end (14), giving it the desired shape, with said end penetrating said over-molding (20) towards the inside of the tube (2) by the channels (11) up to the referred first hoop (8).

20 Claims, 9 Drawing Sheets

(56) References Cited

U.S. PATENT DOCUMENTS

| | | | | | |
|---|---|---|---|---|---|
| 1,406,404 | A | * | 2/1922 | McCrudden | 89/14.2 |
| 1,736,319 | A | * | 11/1929 | Maxim | 181/267 |
| 1,773,260 | A | * | 8/1930 | Cutts | 42/79 |
| 1,939,700 | A | * | 12/1933 | Hofstetter | 89/14.2 |
| 2,101,063 | A | * | 12/1937 | Green | 89/14.2 |
| 2,101,850 | A | * | 12/1937 | Green | 89/14.3 |
| 2,110,165 | A | * | 3/1938 | Moore | 42/75.02 |
| 2,112,831 | A | * | 4/1938 | Cutts, Jr. | 89/14.3 |
| 2,150,161 | A | * | 3/1939 | Green | 89/14.3 |
| 2,165,457 | A | * | 7/1939 | Cutts, Jr. | 89/14.3 |
| 2,365,388 | A | * | 12/1944 | Browning | 89/14.1 |
| 2,467,372 | A | * | 4/1949 | De Permentier | 89/14.1 |
| 2,503,491 | A | * | 4/1950 | Janz | 181/223 |
| 2,662,326 | A | * | 12/1953 | Powell | 42/79 |
| 2,668,479 | A | * | 2/1954 | Batten | 89/14.3 |
| 2,816,484 | A | * | 12/1957 | Grages | 89/194 |
| 2,894,347 | A | * | 7/1959 | Woodcock | 42/75.02 |
| 3,385,164 | A | * | 5/1968 | Hubner et al. | 89/14.4 |
| 3,500,955 | A | * | 3/1970 | Werbell | 181/223 |
| 3,665,804 | A | * | 5/1972 | Rohr | 89/14.3 |
| 3,667,570 | A | * | 6/1972 | WerBell, III | 181/223 |
| 3,713,362 | A | * | 1/1973 | Charron | 89/14.4 |
| 4,576,083 | A | * | 3/1986 | Seberger, Jr. | 89/14.4 |
| 4,769,938 | A | | 9/1988 | Chesnut et al. | |
| 5,355,765 | A | * | 10/1994 | Rogers | 89/14.4 |
| 5,367,940 | A | * | 11/1994 | Taylor | 89/14.3 |
| 5,753,846 | A | * | 5/1998 | Koon | 89/14.3 |
| 5,798,474 | A | * | 8/1998 | Rogers et al. | 89/14.05 |
| 7,707,763 | B2 | * | 5/2010 | Brixius | 42/90 |
| 8,245,618 | B2 | * | 8/2012 | Emde | 89/14.1 |
| 8,312,663 | B2 | * | 11/2012 | Johnson | 42/97 |
| 8,595,971 | B2 | * | 12/2013 | Johnson | 42/97 |
| 2003/0093935 | A1 | | 5/2003 | Huston | |
| 2005/0262997 | A1 | * | 12/2005 | Brixius | 89/14.1 |
| 2010/0058921 | A1 | * | 3/2010 | Brixius | 89/14.1 |
| 2010/0058922 | A1 | | 3/2010 | Casas Salva | |
| 2010/0224053 | A1 | * | 9/2010 | Brixius | 89/14.1 |
| 2012/0272818 | A1 | * | 11/2012 | Dueck et al. | 89/14.4 |
| 2012/0291614 | A1 | * | 11/2012 | Koumbis | 89/14.4 |

* cited by examiner

METHOD FOR MANUFACTURING A BULL BARREL EQUIPPED WITH A SILENCER AND SILENCER-EQUIPPED BULL BARREL THUS OBTAINED

A manufacturing procedure for a "bull barrel" model with silencer and "model bull barrel" with obtained silencer, of the type comprising a barrel with one entrance end and one exit end, characterised in that it comprises the following stages: a first stage in which a tube, which defines two ends: a first and a second, with an inner diameter that exceeds the outer diameter of the barrel, fixed to a wedge by its first end, a second stage in which a muzzle that ends in a hood that is fixed to the second end of the tube, with said muzzle comprising at least one lateral aperture and at least one first hoop that fits inside the tube sealing the second end, similarly with stops that define channels in the hood that connect the exterior with the inside of the muzzle, with the mentioned stops forming the end of travel for the referred tube, a third stage in which the barrel is fixed to the muzzle and to the wedge, thus defining a space or cavity between the tube and barrel and a fourth stage in which the third stage configuration is inserted into a moulding machine that over-moulded with exception of the end entrance of the barrel, giving it the desired shape, with said end penetrating said over-moulding towards the inside of the tube by the channels up to the first hoop.

BACKGROUND TO THE INVENTION

Rifles are known in the state of the art, which are called "bull barrel" and also known as "varmint barrel" in certain sectors.

Said rifles comprise a tube that surrounds the barrel leaving a hollow space or cavity between the barrel and referred tube, giving the visual impression of the barrel being much larger than it actually is.

The type of rifle is widely marketed in various markets, for example, the American. The same applicant company has rifles that are marketed under the series name of VIPER, some models of which are very old and no longer manufactured.

It should be pointed out that these rifles usually do not have any sights; however, this invention enables front and rear sights to be mounted because they can be planned in the over-moulding stage so that their securing is exact.

Thus, European patent No 2112452 is known, in the name of the applicant company from 2007, which refers to a firearm or air rifle with a silencer, of the type comprising a trigger mechanism, a barrel and a chamber with said firearm or air rifle comprising an over-moulded or over-injected silencer so that the barrel and silencer form a single piece.

BRIEF DISCLOSURE OF THE INVENTION

This application is framed within the manufacturing sector of air rifles of the type "bull barrel".

The closest document is the European patent No 2112452. This document describes a procedure for the manufacture of a rifle with silencer in which said silencer is irremovable.

Said silencer is initially an appendix which, after procedure application becomes an integral part of the rifle, in other words, it cannot be removed.

In many countries, including the USA, it is not possible to sell an air or gas sporting rifle with a silencer that is removable, in other words, a silencer that can be separated from the barrel without damaging it.

This patent commences with the applicant's experience with the procedure described in the closest document, but with respect to a whole already existing, in other words, the silencer is not an independent appendix of the rifle that is joined to it in an inseparable manner, but instead, is a "bull barrel" rifle model that has not apparently changed in appearance visually.

Thus, with the procedure and configuration described in the claims, advantage is taken of the space created between the barrel and the tube to reconvert it into a silencer with the aid of the muzzle which, because it is all moulded, cannot be removed. This means that it is a non-removable internal silencer.

Another of the advantages is that it hardly adds any additional weight to the rifle. In other words, it hardly adds any weight compared to what the rifle would weight with a conventional silencer so that the user will barely notice any change in rifle weight.

Moreover, if a conventional silencer is fitted, the barrel length is increased with the consequent stability problems that are involved. This does not occur in this invention because the barrel is not apparently increased since the silencer is fitted inside the same rifle.

The "bull barrel" over-moulding allows any desired shape to be given to it, i.e., exterior fluting, rifle trademark and grip zones etc, so that the outer appearance of the "bull barrel" area can be configured as required by the manufacturer or even the customer.

Lastly, it also means that the barrel does not have to be machined, for example, with a threaded on the barrel tip so that the silencer can be screwed in, which results large savings in rifle manufacturing costs.

Therefore, in appearance, the rifle is the same, with a non-removable silencer, with the exterior image or end part of the silencer/barrel can be designed in accordance with the manufacturer's or even the customer's wishes (fluting, trademark, etc), which is cheaper to manufacture because the barrel does not have to be machined and is highly stable and reliable.

One objective of this invention is a procedure for a barrel model "bull barrel" with silencer, of the type comprising a barrel with one entrance end and one exit end, characterised in that it comprises following stages: a first stage in which a tube, which defines two ends: a first and a second, with an inner diameter that exceeds the outer diameter of the barrel, fixed to a wedge by its first end, a second stage in which a muzzle that ends in a hood that is fixed to the second end of the tube, with said muzzle comprising at least one lateral aperture and at least one first hoop that fits inside the tube sealing the second end, similarly with stops that defines channels in the hood that connect the exterior with the inside of the muzzle, with the mentioned stops forming the end of travel for the referred tube, a third stage in which the barrel is fixed to the muzzle and to the wedge, thus defining a space or cavity between the tube and barrel and a fourth stage in which the third stage configuration is inserted into a moulding machine that over-moulded with exception of the entrance end of the barrel, giving it the desired shape, penetrating said over-moulding towards the inside of the tube by the channels up to the referred first hoop.

An additional objective of this invention is a "bull barrel" model with silencer, of the type comprising a barrel with one entrance end and one exit end, characterised in that comprises a tube, which defines two ends: a first and a second, with an interior diameter that exceeds the outer diameter of the barrel, fixed to a wedge by its first end and this, in turn, to the barrel, which is housed inside the tube, a muzzle that ends in a hood that is fixed to the second end of the tube, with said muzzle comprising at least one lateral aperture and at least one first hoop that fits inside the tube sealing the second end, similarly with stops that define channels in the hood that connect the exterior with the inside of the muzzle, with the mentioned stops forming the end of travel for the referred tube, a space or cavity between the tube and barrel that is defined when the barrel is fixed to the muzzle and an over-moulding that covers the tube except for the entrance end of the barrel, giving it the desired shape, with said over-moulding penetrating towards the inside of the tube by the channels up to the referred first hoop.

BRIEF DESCRIPTION OF THE DRAWINGS

In order to facilitate the description, this report is accompanied by nine sheets of drawings which illustrate a practical embodiment example provided as anon-limiting example of the scope of this invention.

SPECIFIC EXEMPLARY EMBODIMENT OF THIS INVENTION

Figure 1:
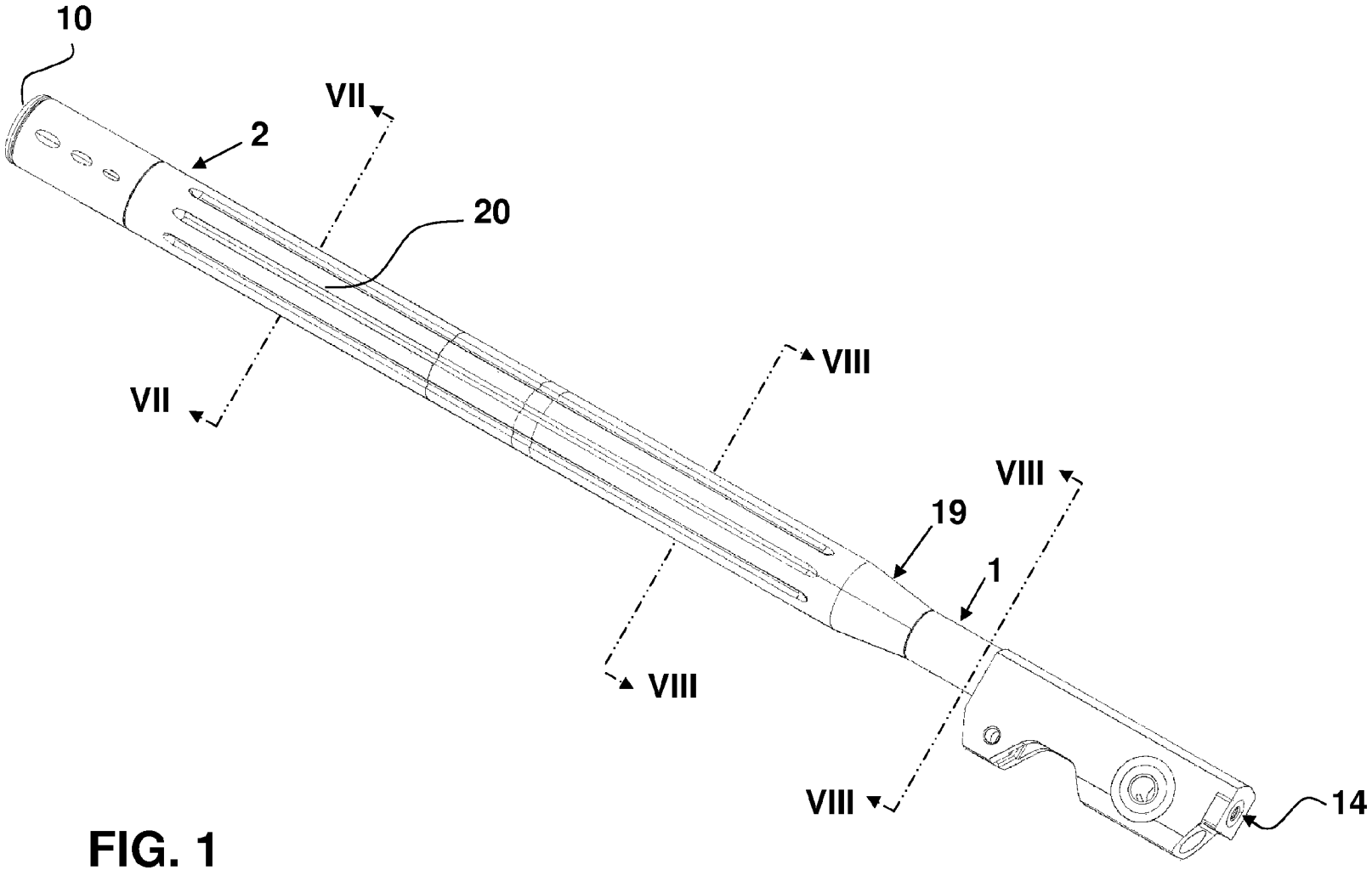
FIG. 1 is a perspective view of the objective of this invention.

Thus, FIG. 1 shows barrel 1, barrel entrance end 14, tube 2, wedge 19, all over-moulded 20 and muzzle hood 10.

Figure 2:
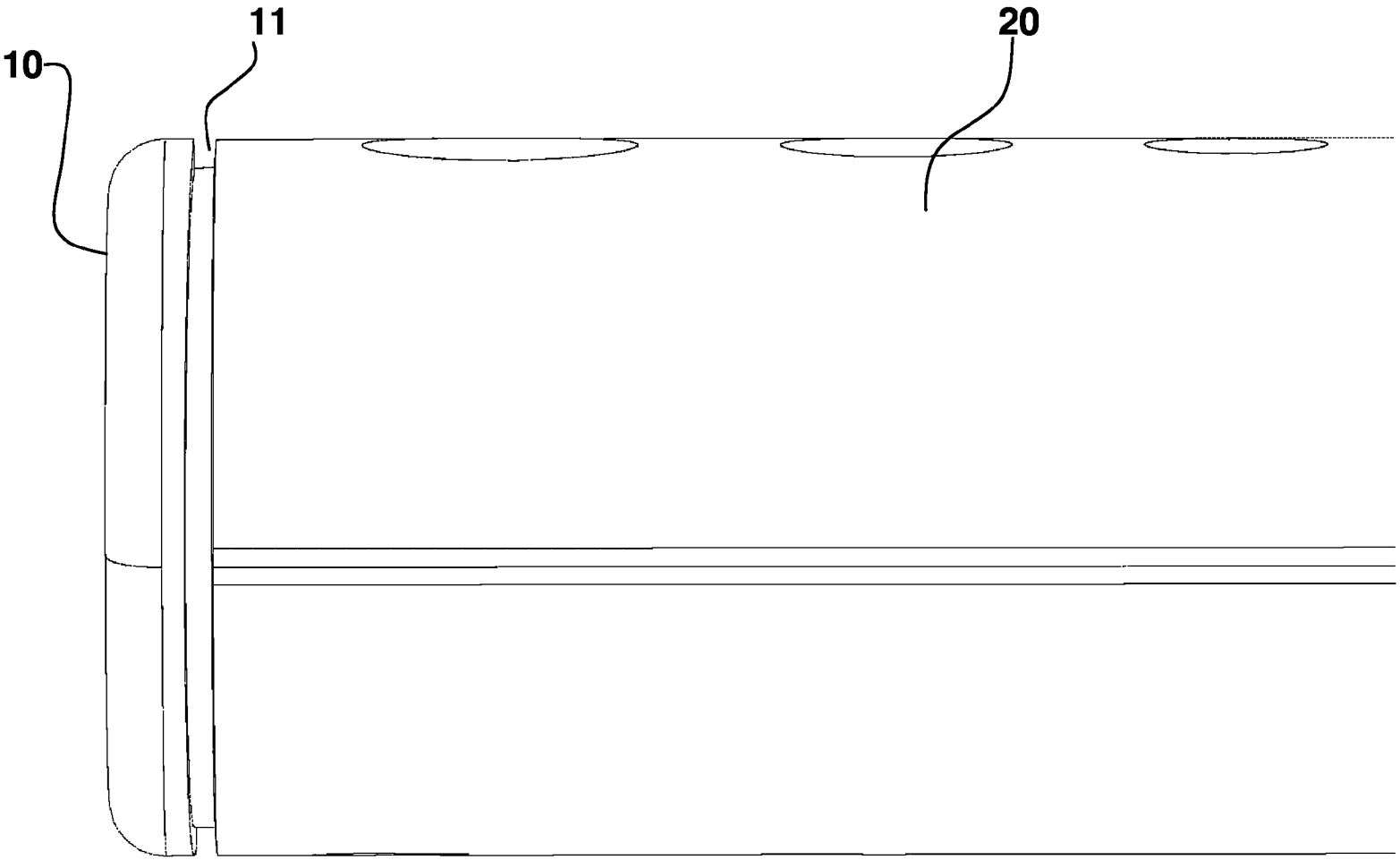
FIG. 2 is an enlarged view of the muzzle mouth.

FIG. 2 shows over-moulding 20, hood 10 and channels 11.

Figure 3:
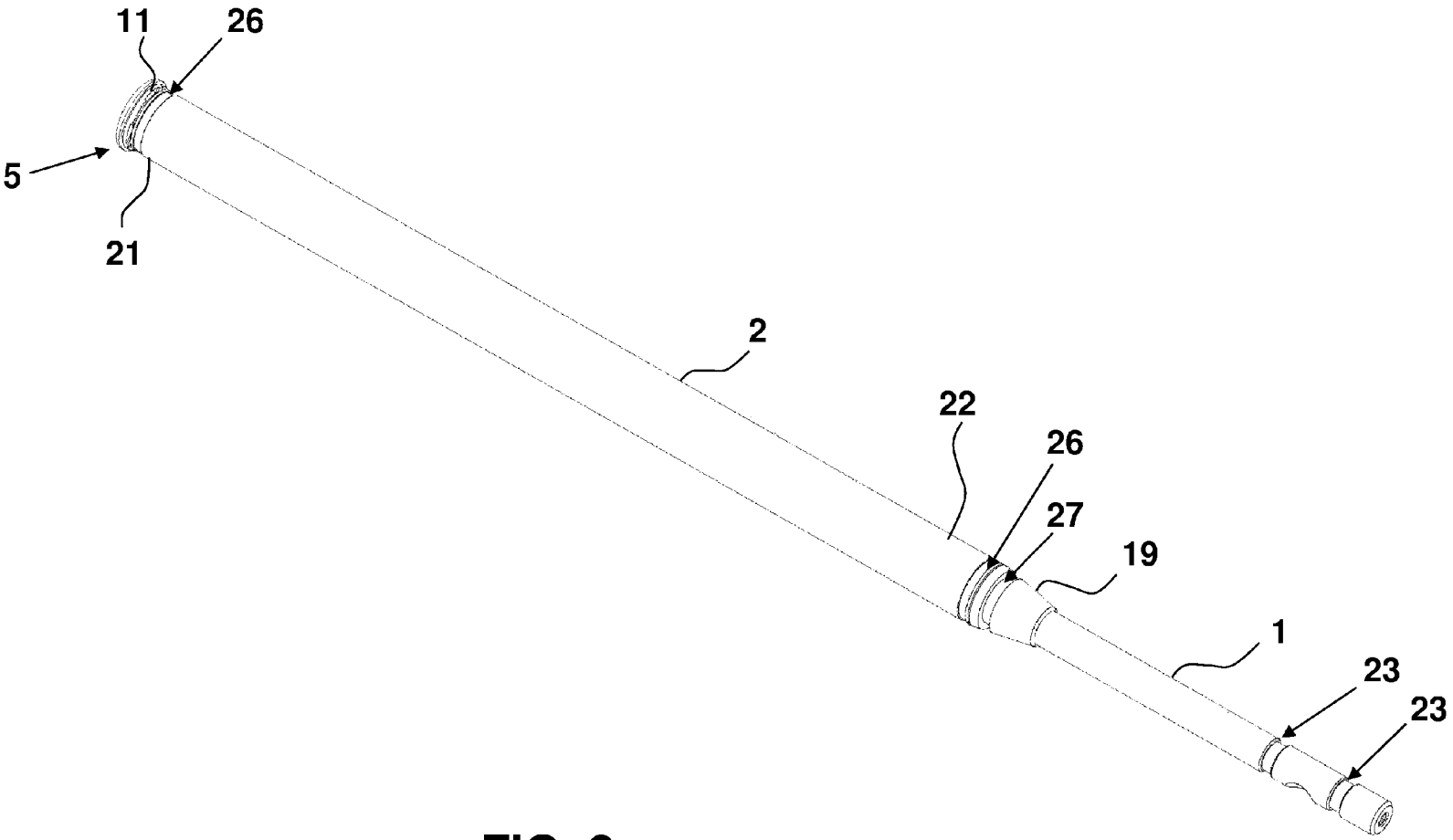
FIG. 3 is a perspective view, as in FIG. 1, without the moulding.

FIG. 3 illustrates barrel 1, tube 2, muzzle 5, with its hood 10 and channels 11, wedge 19, first tube end 21, second tube end 22 and securing slots 23, 26, 27.

Figure 4:
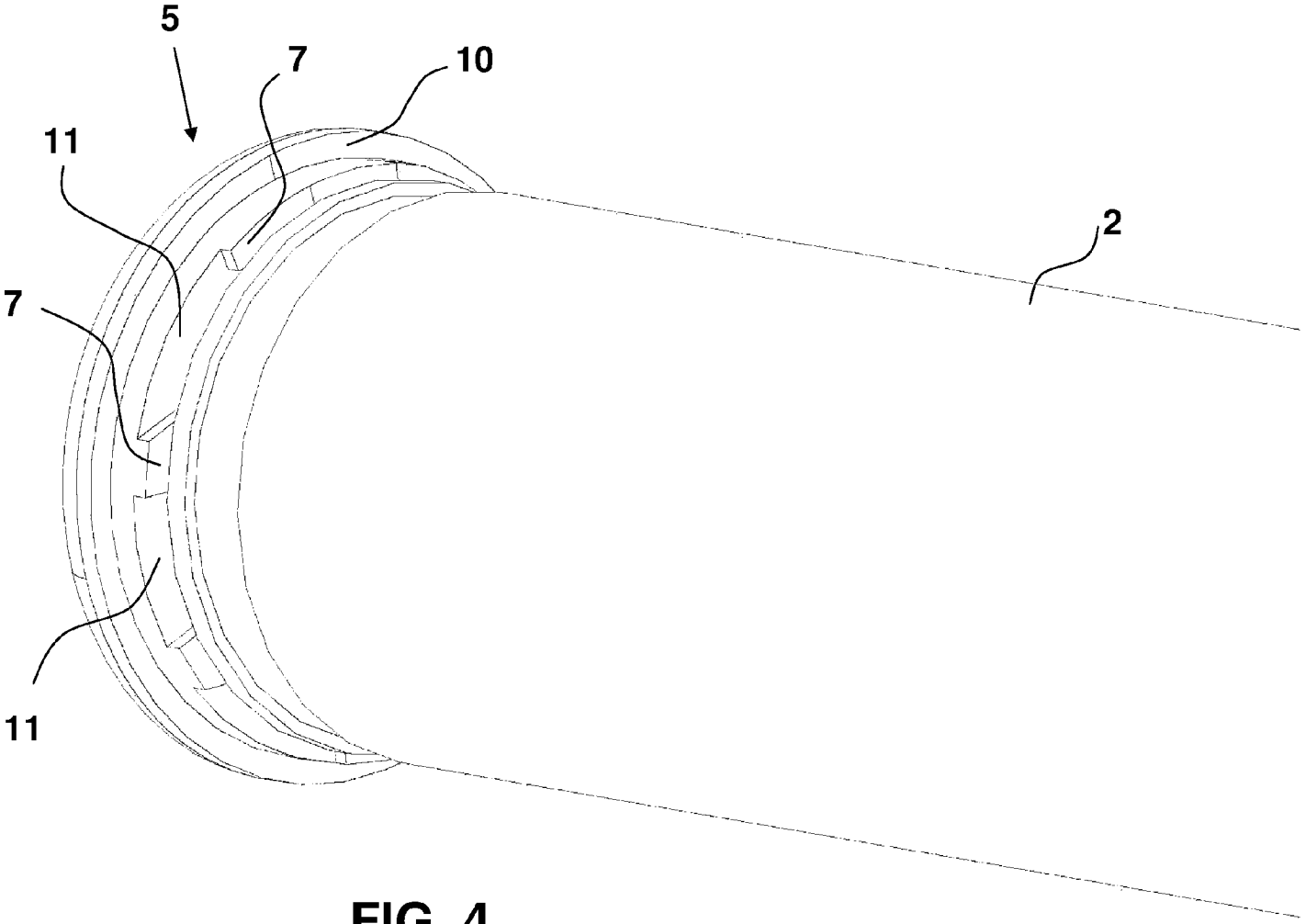
FIG. 4 is an enlarged view of FIG. 3, referring to the muzzle adapter.

FIG. 4 includes tube 2, muzzle 5, hood 10, stops 7 and channels 11.

Figure 5:
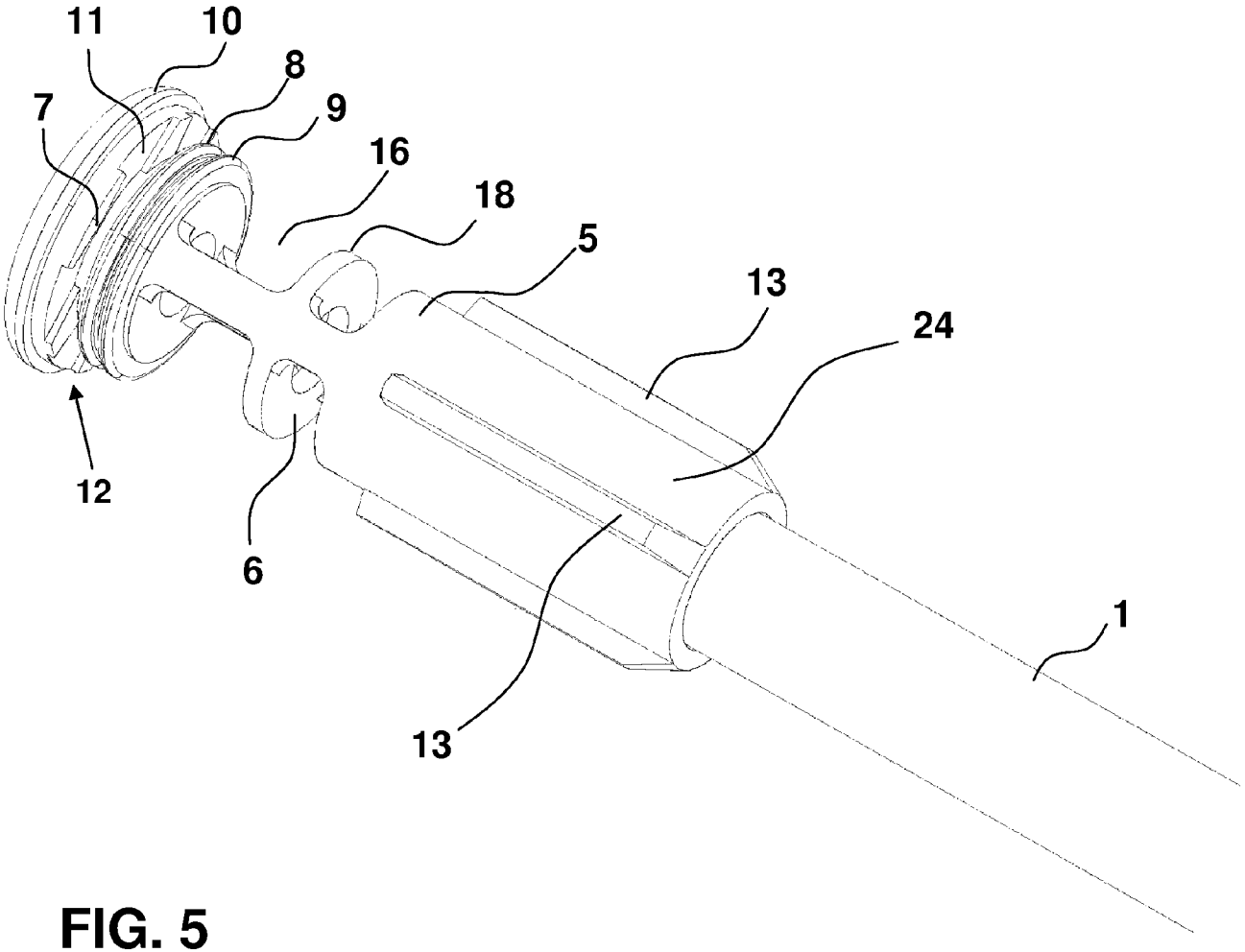
FIG. 5 is an enlarged view of the barrel and muzzle without the tube.

FIG. 5 shows barrel 1, muzzle 5 formed by hood 10 with its lower face 12, stops 7, channels 11, lateral apertures 6, 16, separation wall 18, first hoop 8, second hoop 9, cylindrical body 24 and lateral fins 13.

Figure 6:
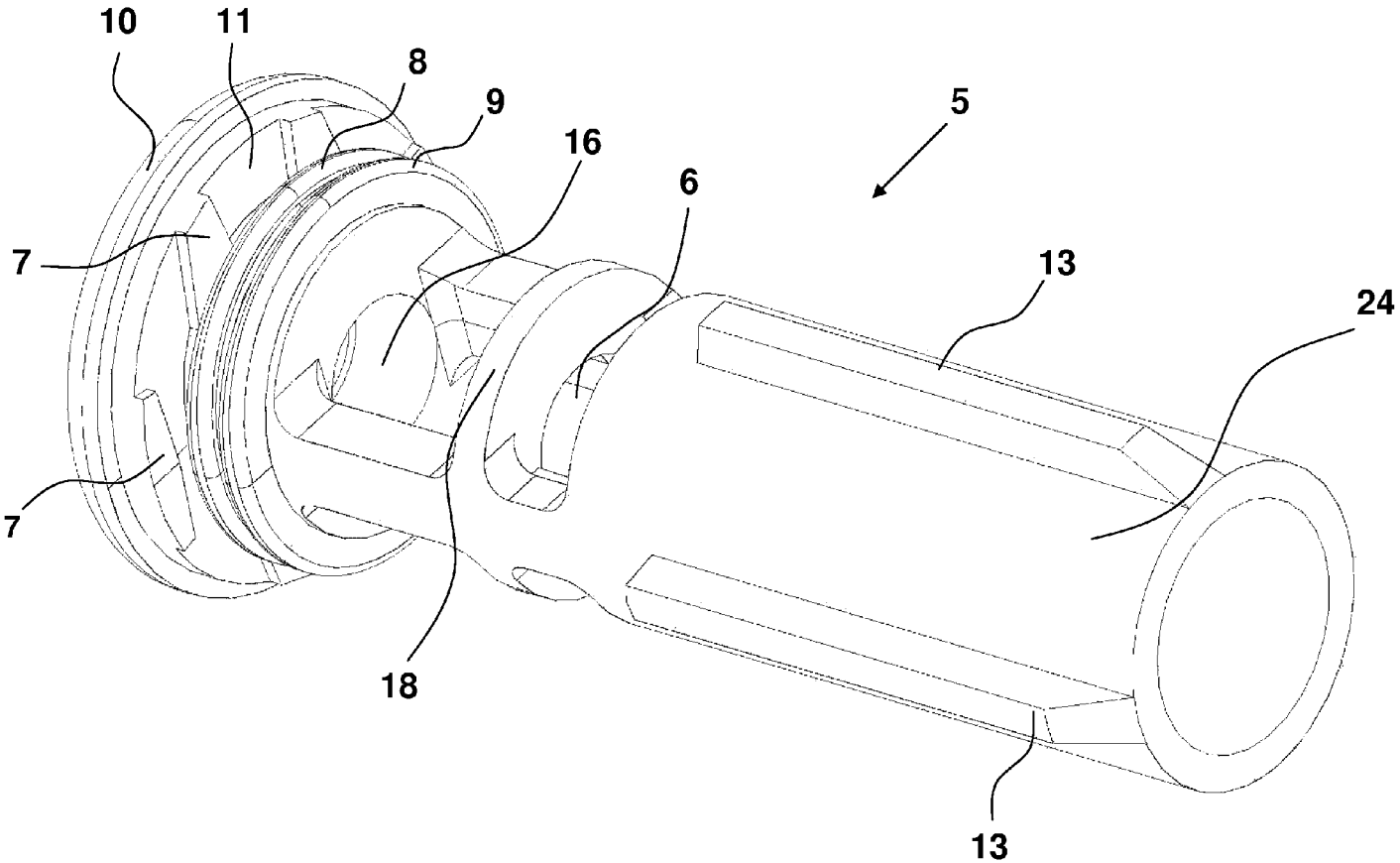
FIG. 6 is a view of the muzzle.

FIG. 6 represents muzzle 5 formed by hood 10, stops 7, channels 11, lateral apertures 6, 16, separation wall 18, first hoop 8, second hoop 9, cylindrical body 24 and lateral fins 13.

Figure 7:
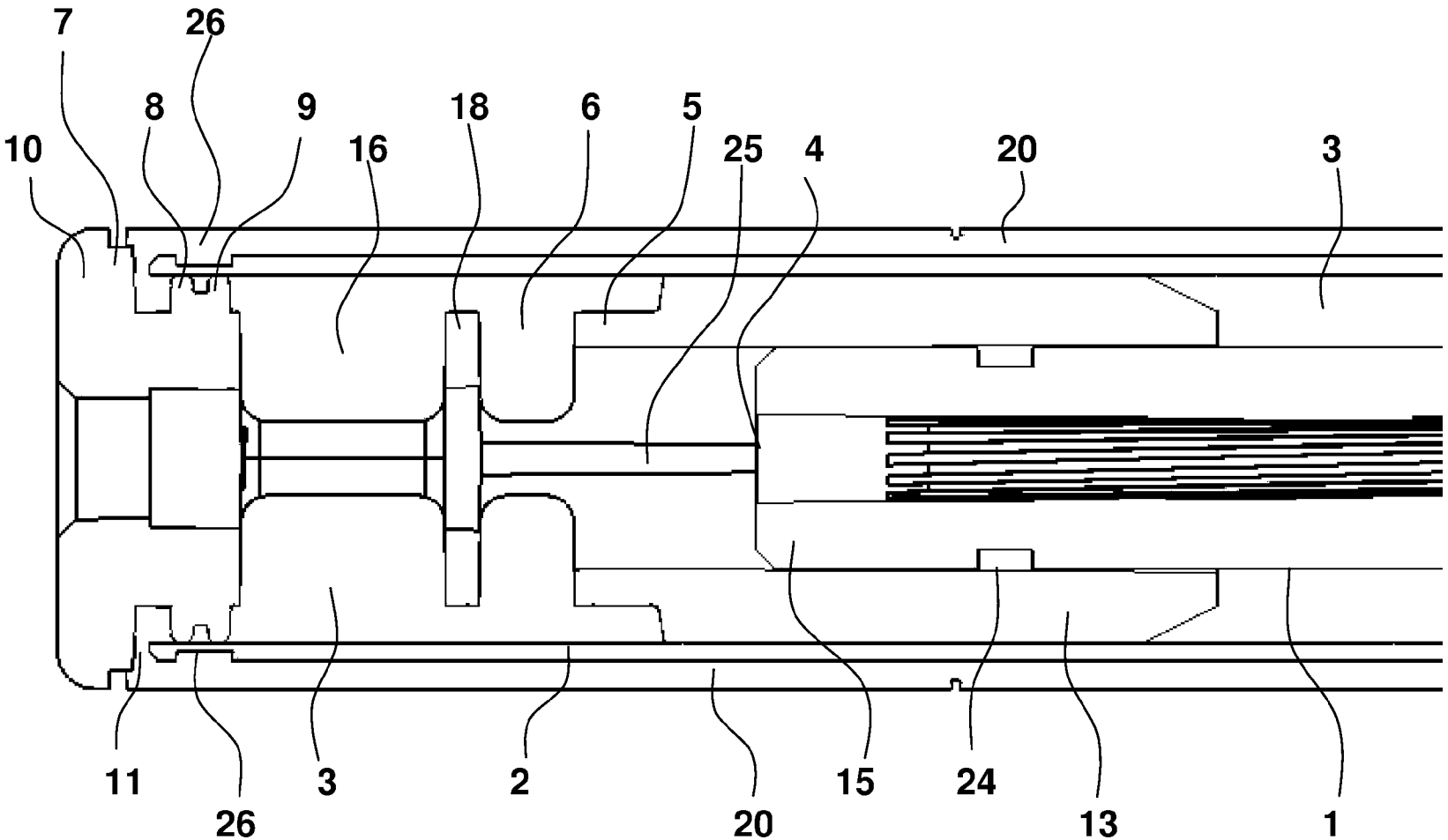
FIG. 7 is a section view of FIG. 2, along line VII-VII.

FIG. 7 shows barrel 1 with its exit end 15, tube 2, which defines a space or cavity 3 between them, rifle mouth 4, over-moulding 20, muzzle 5, hood 10, stops 7, channels 11, lateral apertures 6, 16, separation wall 18, first hoop 8, second hoop 9, cylindrical body 24, stops 25 muzzles interiors, securing slots 26 and side fins 13.

Figure 8:
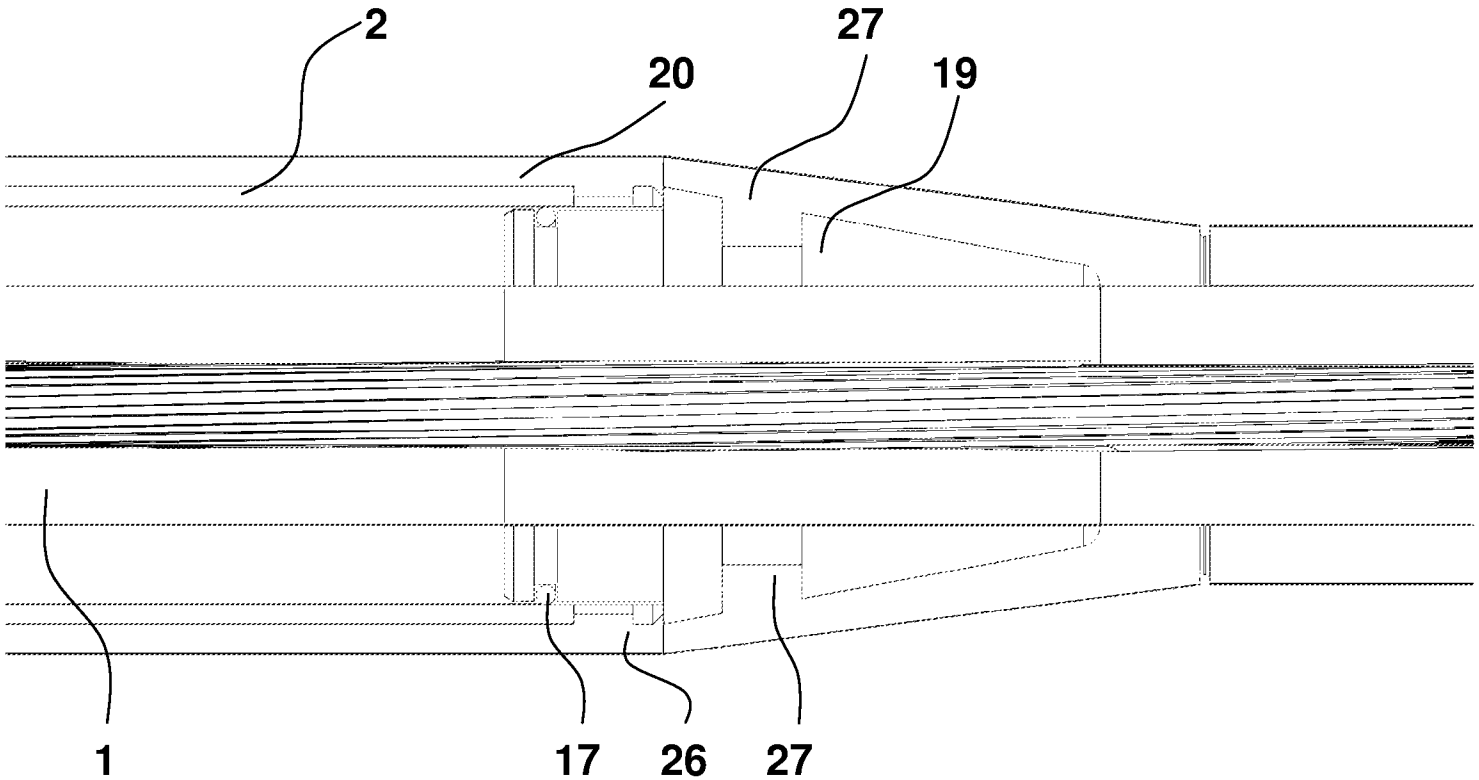
FIG. 8 is a section view of FIG. 2, along line VIII-VIII, y

FIG. 8 illustrates barrel 1, tube 2, over-moulding 20, wedge 19, securing slots 26, 27 and an O-ring 17.

Figure 9:
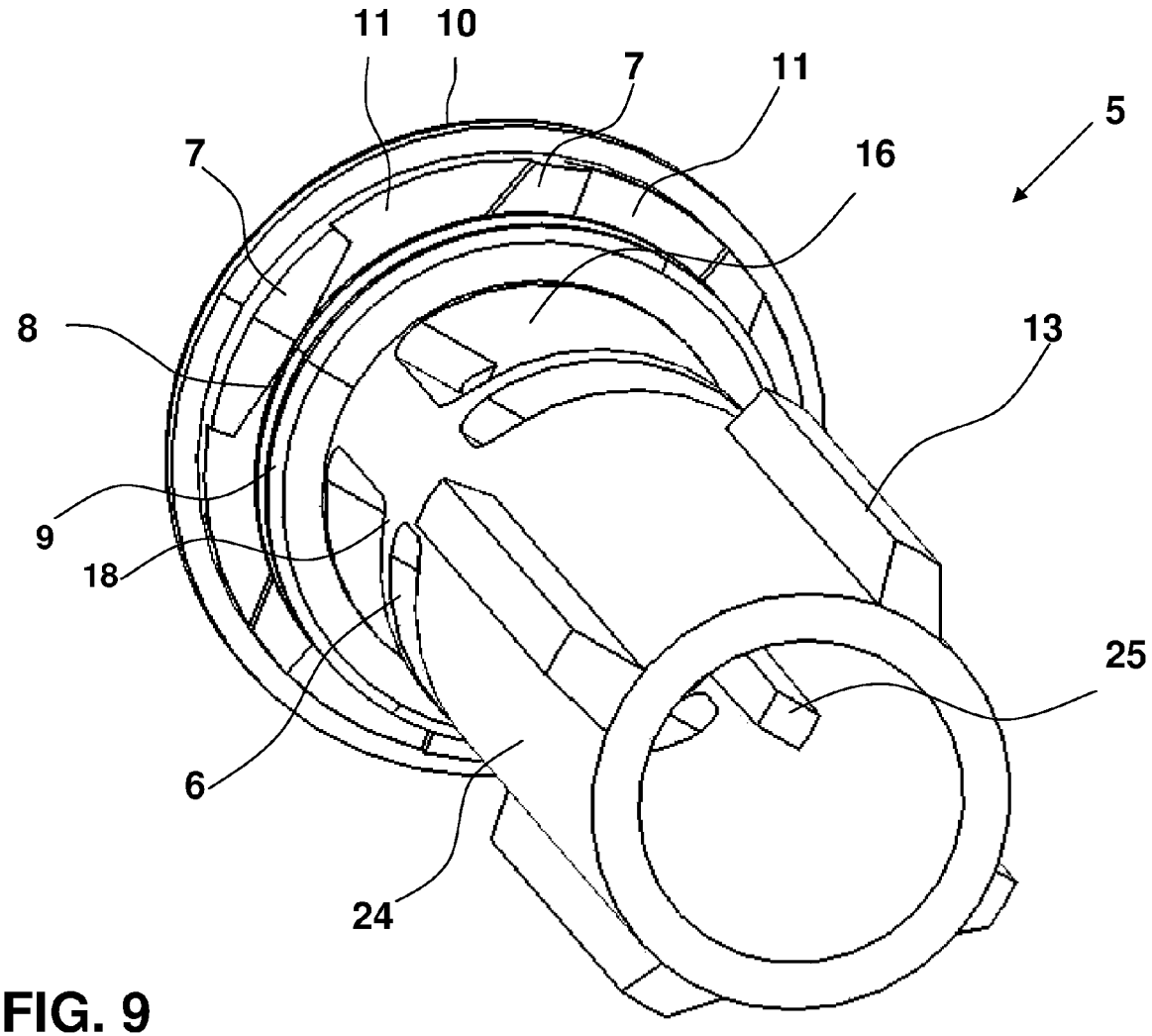
FIG. 9 is a rear perspective view of the muzzle, with an interior view of the same.

Finally, FIG. 9 shows muzzle 5, hood 10, stops 7, channels 11, lateral apertures 6,16, separation wall 18, first hoop 8, second hoop 9, cylindrical body 24, stops 25 muzzles interiors and side fins 13.

Thus, in a specific exemplary embodiment, the model "bull barrel", with silencer, is manufactured as follows.

A first stage, in which tube 2 is fixed to wedge 19 by its first end 21. Tube 2 has an inside diameter that is greater than barrel 1 outside diameter.

Then, in the second stage, muzzle 5, which ends in a hood, is fixed to second end 22 of tube 2.

Muzzle 5 has at least one lateral aperture 6, although this embodiment is shown with two pairs of lateral apertures 6, 16 facing each other, just as illustrated in FIGS. 5, 6, 7 and 9.

Moreover, in this specific embodiment said pairs of lateral apertures 6, 16 two faced two are not equal two faced two. Similarly, between the two pairs of apertures 6, 16, there is a partition wall 18 in the form of a step that creates turbulence. The inventors have established that, in this embodiment, turbulence is created that assists in dissipating noise inside the space of cavity 3, so that excellent results are obtained as a silencer.

It also comprises at least one first hoop 8 that fits into tube 2 to seal the second end 22. It is also fitted with stops 7 that define channels 11 on the hood 10, which connect the exterior to the interior of the muzzle 5, with the over-moulding passing along said channels 11 towards the inside of tube 2.

The stops 7 also form the end of travel for referred tube 2.

In the third stage, barrel 1 is fitted to muzzle 5 and to wedge 19. At the same time, a space of cavity 3 is defined between tube 2 and barrel 1.

The purpose of first hoop 8 is to prevent the access of over-moulding to the rest of the muzzle 5 especially to the barrel 1, in other words, it is unable to access cavity 3 formed by the barrel, tube 2 and muzzle 5.

Moreover, in order to further improve, if possible, the performance of the muzzle 5 the same has been configured to be manufactured in a single piece, so that the mechanical tensions are distributed avoiding thus, the breakage at possible joint points.

The muzzle is fitted with at least one first hoop 8. This first hoop 8 is used to prevent that the over-moulding 20 from moving downwards towards space or cavity 3 or the same barrel 1, when the over-moulding 20 enters inside tube 2. Said first hoop 8 is fitted to the walls of tube 2 and seals off space or cavity 3.

For safety reasons, thought has been given to fitting a second hoop 9, under to the first hoop 8, so that if, for any reason a part of the over-moulding escapes from said first hoop 8, it would be braked by second hoop 9. As with first hoop 8, this second hoop 9 fits on the inside wall of tube 2, also sealing space or cavity 3.

Finally, the third stage configuration is introduced into a moulding machine in the fourth stage, which performs the over-moulding, with exception of the entrance end 14 of the barrel.

In this way, the required form is given to said tube 2, with the fluting of FIG. 1 or the manufacturer's trademark etc, with said over-moulding 20 penetrating towards the inside of tube 2 through channels 11 to the referred first hoop 8, just as previously described.

Over-moulding 20 penetrates inside tube 2 via the channels 11 (FIG. 2) just as previously indicated, which is detained by first hoop 8, which causes the over-moulding to cool and solidify so that no part of said barrel 1 and tube 2 can be separated otherwise it could damage the rifle.

Muzzle 5, as shown in the figures, can comprise a hood 10. Said hood 10 is located on the upper section of the muzzle 5.

Referred hood 10 comprises channels 11. These channels 11 are arranged on lower face 12 of hood 10 so that they are facing barrel 1. The purpose of said channels 11 is to distribute over-moulding 20 towards that inside of tube 2 in a controlled and guided fashion (FIGS. 4, 5 and 6).

Stops 7 form the end-of-travel mechanism for tube 2, leaving referred channels 11 open so that they can penetrate into over-moulding 20.

Muzzle 5 comprises cylindrical body 24 fixed to outside of barrel 1. Interior stops 25 are fitted inside said cylindrical body 24 (FIG. 9) on which barrel end-of-travel stops are supported on barrel 1.

In order to guarantee correct centring of barrel 1 with respect to tube 2, the inventors have used the same muzzle 5. Thus, cylindrical body 24 comprises radially arranged exterior side fins 13 (FIGS. 5, 6 and 9).

In a preferred embodiment, said side fins 13 have a width equivalent to the distance between tube 2 and muzzle 5. In this manner, these side fins 13 (FIG. 7) are adjusted to tube 2 so that they do not allow any movement of barrel 1, nor any deviation.

The initial part of barrel 14 as shown in FIGS. 1, 3 and 8 comprises a wedge 18, joining the tube 2 and the barrel 1. Said wedge 18 is also covered by the over-moulding 20.

There is an O-ring 17 between wedge 18 and tube 2 to improve barrel 1 sealing, making the accidental entry of over-moulding 20 into cavity 3 impossible.

The product obtained with the previously indicated procedure is a "bull barrel" model with silencer. The previous procedure can be employed with both rifles and pistols.

The obtained "bull barrel" model is of the type comprising tube 2 that is fixed to the initial part 14 of barrel 1. When connected, space or cavity 3 is left between them. Similarly barrel mouth 4 and its respective part of the tube remain open.

Muzzle 5 fits into barrel 1, FIG. 5. Said muzzle 5, when fitted to barrel 1, at the same time covers the referred tube 2 on its final part. In order to allow the passage of the over-moulding 20, channels 11 are provided between muzzle 5 and the tube 2 so that it forms entrance for the over-moulding towards the inside of tube 2.

Muzzle 5 is able to carry out its function from a lateral aperture 6. In this embodiment, as illustrated in FIGS. 5, 6, 7 and 9, it is seen with two pairs of lateral apertures 6, 16 facing each other.

Moreover, in this embodiment said pairs of lateral apertures 6, 16 two faced two are not equal. Similarly, between the two pairs of apertures 6, 16, there is a partition wall 18. Said partition wall 18 is configured as a step that creates turbulence. The inventors have established that, in this embodiment, turbulence is created by the combination of the unequal lateral apertures 6, 16 and the partition wall 18, that assists in dissipating noise inside the space of cavity 3, so that excellent results are obtained as a silencer.

In order to further improve, if possible, the performance of the muzzle 5, the same has been configured to be manufactured in a single piece, so that the mechanical tensions are distributed avoiding thus breakage at possible joint points.

The muzzle is fitted with at least one first hoop 8 that is fitted into the walls of tube 2. This first hoop 8 is used to prevent that the over-moulding 20 from moving downwards towards space or cavity 3 or the same barrel 1, when said over-moulding 20 enter inside tube 2.

As described earlier, safety reasons, thought has been given to fitting a second hoop 9, under the first hoop 8. Thus, if first hoop 8 is not enough to detain all the over-moulding 20, second hoop 9 will collect all over-moulding 20 that could filter through and prevent it from reaching tube 2 or barrel 1. As with first hoop 8, this second hoop 9 fits on the inside wall of tube 2, also sealing space or cavity 3.

Over-moulding 20, apart from making the rifle barrel non-removable, provides the required form to said tube 2 with fluting shown in FIG. 1 or the manufacturer's trademark etc.

Securing slots 23, 26, and 27 are provided in fourth stage over-moulding that stabilise the over-moulding 20 on the tube 2, the barrel 1 and the wedge 19.

The function of channels 11 (FIG. 2) is to allow over-moulding 20 to enter inside tube 2. When said over-moulding 20 enters inside tube 2, it is similarly delimited by muzzle 5, which will detain over-moulding 20 by first hoop 8 and that when the mentioned over-moulding 20 is cooled and solidified, no part of said barrel 1 and tube 2 can be separated.

Muzzle 5 has been configured with hood 10 in this embodiment. Said hood 10 is located on the upper section of the muzzle 5.

Referred hood 10 comprises channels 11. These channels 11 are arranged on lower face 12 of hood 10 so that they are facing barrel 1. The purpose of said channels 11 is to guide and to distribute the over-moulding 20 towards the inside of tube 2 in a controlled and guided fashion (FIGS. 4, 5, 6 and 9).

As described for the procedure, muzzle 5 comprises exterior radial side fins 13, than the barrel 1. Moreover, these side fins 13 have a width equivalent to the distance between tube 2 and muzzle 5, thus preventing that the barrel 1 decenters because said lateral fins 13 fitted inside the space or cavity 3, immobilise the barrel 1.

The first end of tube 21 comprises wedge 16 that joins tube 2 to barrel 1 and which is covered by over-moulding 20.

There is at least one O-ring 17 between wedge 18 and tube 2 to improve barrel 1 and tube 2 sealing and to prevent over-moulding 20 from entering tube 2.

In this way, when the rifle is fired, the noise is dispersed by turbulence that is created in lateral apertures 6, 16, together with partition wall 18 and which would be dissipated through the spaces existing between the side fins 13 to the rest of the space or cavity 3.

This means that space or cavity 3 between tube 2 and barrel 1 is used as a silencer, but which cannot be removed from the barrel in compliance with current legislation in countries such as the USA.

This invention patent describes a procedure for the manufacture of a "bull barrel" model with silencer and "bull barrel" model with obtained silencer. The examples mentioned here do not limit this invention and, for this reason, it may have various applications and/or adaptations, all within the scope of the following claims.

The invention claimed is:

1. A manufacturing procedure for a "bull barrel" model with silencer of the type comprising a barrel (1) with one entrance end (14) and one exit end (15), characterised in that it comprises the following stages:

A first stage in which a tube (2), which defines two ends: a first (21) and a second (22), with an inner diameter that exceeds the outer diameter of the barrel (1), fixed to a wedge (19) by its first end (21), A second stage in which a muzzle (5) that ends in a hood (10) is fixed to the second end (22) of tube (2), with said muzzle (5) comprising at least one lateral aperture (6) and at least one first hoop (8) that fits inside the tube (2) sealing the second end (22), similarly with stops (7) that define channels (11) in the hood (10) that connect the exterior with the inside of the muzzle (5), with the mentioned stops (7) forming the end of travel for the referred tube (2), A third stage in which the barrel (1) is fixed to the muzzle (5) and to the wedge (19), thus defining a space or cavity (3) between the tube (2) and barrel (1) and A fourth stage in which the third stage configuration is inserted into a moulding machine for over-moulding, except for the barrel entrance end (14), giving it the desired shape, with said end penetrating said over-moulding (20) towards the inside of the tube (2) by the channels (11) up to the referred first hoop (8).

2. A procedure in accordance with claim 1, characterised in that muzzle (5) comprises a second hoop (9), underneath first hoop (8).

3. A procedure in accordance with claim 1, characterised in that muzzle (5) comprises cylindrical body (24) fixed to outside of barrel (1), the inside of which comprises stops (25) which support barrel (1).

4. A procedure in accordance with claim 3, characterised in that muzzle (5) comprises exterior radial side fins (13) located on the cylindrical body (24) for centring barrel (1).

5. A procedure in accordance with claim 4, characterised in that said side fins (13) have a width equivalent to the distance between tube (2) and muzzle (5).

6. A procedure in accordance with claim 1, characterised in that there is at least an O-ring (17) between wedge (18) and tube (2).

7. A procedure in accordance with claim 2, characterised in that muzzle (5) comprises at least two pairs of lateral apertures (6, 16) facing each other.

8. A procedure in accordance with claim 7, characterised in that said two pairs of lateral apertures (6, 16) two faced two are not equal two faced two, with a partition wall (18) between them in the form of a step to create turbulence.

9. A procedure in accordance with claim 8, characterised in that muzzle (5) comprises a single piece.

10. A procedure in accordance with claim 1, characterised in that the fourth stage over-moulding, at least in the tube (2), barrel (1) and wedge (19) includes securing slots (23, 26, 27) that stabilize the over-moulding (20) on the tube (2), barrel (1) and wedge (19).

11. A "bull barrel" model with silencer of the type comprising a barrel (1) with one entrance end (14) and one exit end (15), characterised in that it comprises:

a tube (2), which defines two ends: a first (21) and a second (22), with an interior diameter that exceeds the outer diameter of the barrel (1), fixed to a wedge (19) by its first end (21) and, in turn, to the barrel (1), which housed inside tube (2), a muzzle (5) that ends in a hood (10) is fixed to the second end (22) of tube (2), with said muzzle (5) comprising at least one lateral aperture (6) and at least one first hoop (8) that fits inside the tube (2) sealing the second end (22), similarly with stops (7) that define channels (11) in the hood (10) that connect the exterior with the inside of the muzzle (5), with the mentioned stops (7) forming the end of travel for the referred tube (2), a space or cavity (3) between the tube (2) and barrel (1) which is defined when the barrel (1) is fixed to the muzzle (5) and wedge (19) and an over-moulding (20) that covers the entire tube (2) except for the barrel entrance end (14), giving it the desired shape, with said end penetrating said over-moulding (20) towards the inside of the tube (2) by the channels (11) up to the referred first hoop (8).

12. "Bull barrel" model with silencer, in accordance with claim 11, characterised in that muzzle (5) comprises a second hoop underneath (9), underneath the first hoop (8).

13. "Bull barrel" model with silencer, in accordance with claim 11, characterised in that muzzle (5) comprises cylindrical body (24) fixed to outside of barrel (1), the inside of which comprises stops (25) which support barrel (1).

14. "Bull barrel" model with silencer in accordance with claim 11, characterised in that muzzle (5) comprises exterior radial side fins (13) located on the cylindrical body (24) for centring barrel (1).

15. "Bull barrel" model with silencer in accordance with claim 14, characterised in that said side fins (13) have a width equivalent to the distance between tube (2) and muzzle (5).

16. "Bull barrel" model with silencer in accordance with claim 11, characterised in that there is an O-ring (17) between wedge (18) and tube (2).

17. "Bull barrel" model with silencer in accordance with claim 11, characterised in that muzzle (5) comprises at least two pairs of lateral apertures (6, 16) facing each other.

18. "Bull barrel" model with silencer in accordance with claim 17, characterised in that said two pairs of lateral apertures (6, 16) are not equal, with a partition wall (18) between them in the form of a step to create turbulence.

19. "Bull barrel" model with silencer in accordance with claim 18, characterised in that muzzle (5) comprises a single piece.

20. "Bull barrel" model with silencer in accordance with claim 11, characterised in that, securing slots (23, 26, 27) are included at least on the tube (2), barrel (1) and wedge (19).

* * * * *